US008746471B2

(12) United States Patent
Hiller et al.

(10) Patent No.: US 8,746,471 B2
(45) Date of Patent: Jun. 10, 2014

(54) JEWEL DISPLAY HOLDER

(76) Inventors: Diane Esther Hiller, Arlington, VA (US); Sydney Rose Hiller, Arlington, VA (US)

( * ) Notice: Subject to any disclaimer, the term of this patent is extended or adjusted under 35 U.S.C. 154(b) by 244 days.

(21) Appl. No.: 13/196,879

(22) Filed: Aug. 2, 2011

(65) Prior Publication Data

US 2013/0032556 A1 Feb. 7, 2013

(51) Int. Cl.
*A47F 7/02* (2006.01)

(52) U.S. Cl.
USPC ..... 211/85.2; 206/6.1

(58) Field of Classification Search
USPC ..... 211/85.2; 40/299.01; 206/6.1
See application file for complete search history.

(56) References Cited

U.S. PATENT DOCUMENTS

| | | | | | |
|---|---|---|---|---|---|
| 1,698,388 | A * | 1/1929 | Brown | 211/85.3 |
| D248,801 | S * | 8/1978 | Tafoya | D6/468 |
| 5,033,625 | A * | 7/1991 | Campbell | 211/85.2 |
| 5,160,049 | A * | 11/1992 | McMillen, Jr. | 211/85.2 |
| D343,535 | S * | 1/1994 | Scott | D6/469 |
| D361,451 | S * | 8/1995 | Reiland | D6/466 |
| 6,056,130 | A * | 5/2000 | Ovadia | 211/85.2 |
| 6,206,208 | B1 * | 3/2001 | Dennig | 211/85.2 |
| 6,244,431 | B1 * | 6/2001 | VanFleet | 206/6.1 |
| 6,471,077 | B1 * | 10/2002 | Johnson | 211/85.2 |
| 7,143,892 | B2 * | 12/2006 | Kolton et al. | 206/6.1 |
| 7,458,457 | B2 * | 12/2008 | Hiller et al. | 206/6.1 |
| 7,878,333 | B1 * | 2/2011 | Necessary | 206/6.1 |
| 2005/0194334 | A1 * | 9/2005 | Johnson | 211/85.2 |
| 2009/0050588 | A1 * | 2/2009 | Riley | 211/85.2 |
| 2010/0236287 | A1 * | 9/2010 | Summerford | 206/6.1 |
| 2011/0266162 | A1 * | 11/2011 | Puls | 206/6.1 |

* cited by examiner

*Primary Examiner* — Jose V Chen
(74) *Attorney, Agent, or Firm* — Novick, Kim & Lee, PLLC; Harold L. Novick; Sang Ho Lee

(57) ABSTRACT

A jewelry holder for gem-stones or jewels, such as of the type that could be mounted onto a jewel stud or stud-like pierced earrings, is provided. In a presently preferred embodiment, the jewelry holder is generally elongated and is made of a rigid, transparent material. The holder has a handle portion and a distal tip portion. The body of the holder has one hole, or preferably a plurality of one vertically aligned hole(s) or bore(s) and a jewel mounted in each hole(s). In use, jewels of different shapes, sizes, types, colors and/or cuts are placed in the holes within the body of the holder for display and trying on and/or purchasing. The holder can be held up against the user's body to see what that jewel would look like when inserted into, for example, an earlobe.

17 Claims, 6 Drawing Sheets

JEWEL DISPLAY HOLDER

FIELD OF THE INVENTION

The present invention relates to the field of displays, and in particular relates to display holders for jewels.

BACKGROUND OF THE INVENTION

When selecting a jewel, it is desirable to have some mechanism for simultaneously comparing different jewels, particularly if one is purchasing a jewel to be mounted to a stud that would be insertable in pierced ears. A holder can facilitate the availability of trying on and/or purchasing a mounted jewel stud, inter alia, in the most commonly used varieties, types, shapes, sizes, colors, cuts, and the like. Further, a holder that increases the relative ease and ability of trying on and/or purchasing jewel studs is even more desirable. Persons and entities marketing jewels for sale, for example, desire to use a jewel holder that shows the types of jewels as effectively as possible. Moreover, a holder that eliminates a person's need to handle an item (or insert into an earlobe or other body part) prior to purchase is advantageous at least for health and safety reasons.

In the terms of this application, the word jewel is synonymous with the word gem and the word gemstone and is a very broad term that encompasses without limitation, for example, real and artificial; rough and cut; natural and man-made or synthetic; colored and natural coloring; crystals and garnets; and precious, semiprecious, and glass. The phrase jewel type includes such different types as diamonds; zirconia; rhinestones; rubies; pearls including fresh water and salt water; aquamarine; tourmaline; beryl; chrysoberyl including cat's eye; opal; garnet and mandarin garnet; peridot; amber; topaz; corundum including rubies and sapphires and orange sapphires; quartz including citrines and blue and rose quartz; amethysts; onyx and carnelian; turquoise; agate; lapis lazuli; jade; moonstone; tanzanite; emery; spinel; zircon; tiger eye; malachite; and sandstone.

Jewels are selected by type, shape, size, color, cut, clarity, and the like. Some exemplary jewel shapes include round, brilliant and brilliant modified; princess cut; emerald cut; pear; oval; heart; trillion; marquise; asscher; cushion; square and other quadrilateral shapes or polygon; and pearl shape.

There is a desire of those marketing jewels to provide an efficient way for purchasers to see and try different jewels in a relatively easy way. For example, a person desiring to purchase a jewel that for example, can be made into an earring, may not have a lot of time to investigate the very large number of varieties, as mentioned above. However, if that same purchaser could see how different varieties would look as, for example, an earring looks in their ear, compare the earring to others, and do so in a clean environment—in a matter of seconds, they may be more likely to do so. Thus, there is a need for a comprehensive holder can meet the needs of buyers and sellers alike.

SUMMARY OF THE DISCLOSURE

The present invention provides a holder for mounted jewels or free jewels of different types which can, for example, increase and facilitate the ease of selecting a jewel that can be made or mounted into, for example, a stud-type pierced earring in a variety of types, shapes, sizes, colors, cuts, and the like, or which has already been so made or mounted.

In the present invention, each jewel holder can be manufactured with a specific selection of type of gemstone, color, cut, size and the like, so that a buyer can compare gemstones. The gemstones, for example, may be in a "crystal" or glass version. Such embodiment of the gemstones creates a cost effective and user-friendly way to display their appearance. Also as an example, one holder may display a different combination of a gemstone, or a different combination of size, cut, color, and the like. For example, three radiant cut diamonds (represented by clear crystals or rhinestones) in 0.25 carat, 0.33 carat, and 0.75 sizes may be shown in one holder.

The present invention also provides a means for manufacturers and retailers, for example, to market and sell jewels for earrings of the aforementioned types including but not limited to the following jewel shapes: round brilliant, brilliant modified, princess cut, emerald, pear, oval, heart, trilliant, marquise, asscher, cushion, square, quadrilateral, polygon, pearl, natural round pearls, freshwater pearls, and mother of pearl. The aforesaid shapes and types can be in all sizes, colors, and configurations.

In a first specific embodiment, the present invention comprises a holder for the temporary positional display of a plurality of jewels so that a user can view the jewels when they are positioned against the user's body. The holder has an elongate body with a thinner width than length thereof. The body has a first end portion, a mid portion that is integral with the first portion and a second end portion that is integral with the mid portion. Further, the body, including the second end portion, has a size and shape such that it can be used as a handle by the user. The holder is configured to hold a plurality of jewels fixedly attached at the first end, such that the jewels are visible from one side of the holder. The holder can also include a back for the jewel to rest on or which can be opaque or transparent so that the jewels are visible from either side of the holder.

In another or the same embodiment of the present invention as above, the body is one piece, transparent, and the first end portion is tapered. The jewels are fixedly attached to the first tapered end and spaced longitudinally apart at a predetermined distance so that when positioned against a user there is a visually distinctive and individual view of each of the jewels.

In another embodiment of the present invention, there is a disk rotatably attached near the end of the first end portion, the disk having a plurality of jewels embedded in the first tapered end. Further, the jewels embedded in the disk are spaced apart radially at a minimum distance so that when positioned against the user there is a visually distinctive view of any one jewel. The disk can be made of a transparent material.

In another embodiment the holder material is lightweight and scratch resistant, and can be made of glass, for example.

In another embodiment, the holder material may also be made of a thin, rigid, non-brittle plastic that can be cleaned with soap and water. The plastic may be a methyl methacrylate polymer.

In yet another embodiment the body of the holder is made of a clear, transparent, rigid, non-brittle, non-fogging, thin, lightweight, scratch resistant plastic material.

In yet another specific embodiment, the body of the holder has a preferred width at said tapered first end that is about one-fifth the width of said second end, although other broader or narrower widths can be used, depending upon the particular design and shape of the body.

In yet another embodiment the first end portion, middle portion, said second end portion of said body are symmetrical about its own axis. Additionally, the axes of the first end portion, the middle end portion and second end portion of the body can be collinear from a front view elevation perspective.

In yet another embodiment, the second end portion portrays a design.

In yet another embodiment, the axes of said first end portion, middle portion, said second end portion of said body form an arcuate shape in a front elevation view, with a plurality of jewels fixedly attached to said first tapered end, said jewels spaced arcuately apart at a minimum distance such that when positioned against said user there is a visually distinctive view of any one jewel. Further, the second end portion is tapered and has a plurality of jewels fixedly attached to the second tapered end, said jewels are spaced arcuately apart at a minimum distance such that when positioned against said user there is a visually distinctive view of any one jewel.

In yet another aspect of the invention, the holder contains a plurality of jewels, which consists of one each of the same jewel type in a progression of sizes of the same cut and color.

In yet another aspect of the invention the plurality of jewels consists of one each of the same jewel type in a variety of cuts of the same size and color.

In yet another aspect of the invention the plurality of jewels consist of one each of the same jewel type in a variety of colors of the same size and cut.

In yet another aspect of the invention the plurality of jewels consists of one each of various jewel types of the same size.

According to a further aspect of the present invention a holder for the temporary positional display of a plurality of groups of jewels is so that a user can see how many any one of said jewels will look when positioned against the body of said user.

According to yet another aspect of the present invention there is a method for viewing how a jewel of a pierced earring will appear against the body of the user. Additionally, a plurality of jewels can be fixedly attached to a holder made of transparent material and the holder is held against the body of said user to simulate the position of the jewel.

DETAILED DESCRIPTION OF THE INVENTION

Figures 1, 2:
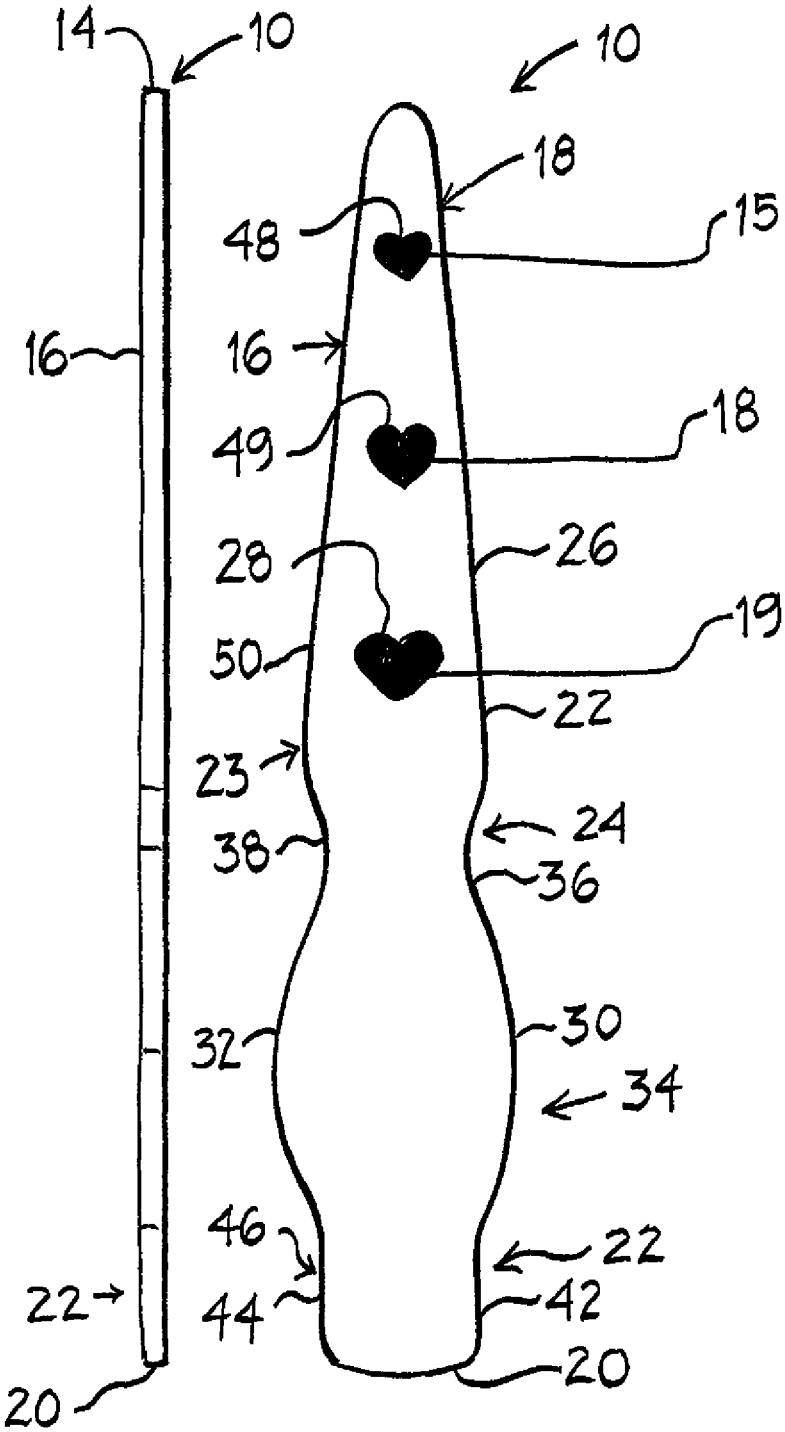
FIG. 1 is a front elevational view in actual size scale of a holder in accordance with one embodiment of the present invention in which the holder has an overall elongate shape.
FIG. 2 is a side elevational view in actual size scale of the holder of FIG. 1.

With reference now to the drawings wherein like elements throughout the several views have like identification numerals, and in particular with reference to FIGS. 1 and 2, a generally collinearly shaped jewel wand or holder 10 in accordance with the present invention is depicted. Location or position terminology, such as upper, is relative, and is for convenience and understanding of the present invention. Such terminology refers only to the orientation of a particular drawing.

Holder 10 is comprised of an elongated, one-piece base or body 12 that is symmetrical about a central longitudinal axis (not shown). Holder 10 has a constant thickness and a rounded first end 14 integral with and located at the terminus of an upper, elongate triangular-like or pointed portion 16. Body 12 has a second end 20 at the terminus of an elongate, bulbous handle portion 22 in elevational view. Intermediate first end 14 and second end 20 is a mid-portion 23. Handle portion 22 is integral and coplanar with mid-portion 23 at a junction 24, and triangular pointed portion 16 is integral and coplanar with mid-portion 23. Second end 20 is wider than first end 14, but is still curvilinear with a much larger curvature of radius than the curvature of radius of first end 14. Holder 10 has a first side edge 26 and an opposite second side edge 28 which extend from ends 14 and 20.

Distinctly spaced, vertically aligned jewel receiving bores or holes 17, 18 and 19 are located in portion 16 and are spaced apart longitudinally from first end 14 and vertically aligned with each other. In this particular embodiment, mid-portion 17 has holes that extend completely through body 12. Holes 17, 18, and 19 need not be vertically, co-lineally aligned, but are vertically separated from one and another so that different sections can be viewed apart of the others.

In order to be held comfortably by the user's hand, handle portion 22 is contoured at the bottom. Handle portion 22 has concave first outer edges 30 and 32 beginning from junction 24 with pointed portion 16 which together form a grip region 34. First outer edges 30 and 32 integrally mate with first ends of convex second outer edges 36 and 38 that together form a bulbous section 40 of handle portion 22. Concave third outer edges 42 and 44 which together form a butt section 46 of handle portion 22 integrally mate with second ends of convex second outer edges 36 and 38. In addition in order to increase the comfort of handle portion, the edges of sides 26 and 28 can be rounded.

Holes 17, 18, and 19 are heart shaped and accommodate therein conventional heart shaped jewels such as diamonds 48, 49 and 50 having respective exemplary weights of 1.00 carat, 1.50 carats and 2.00 carats. However, the shape of holes 17, 18 and 19 can have a shape so as to accommodate any of the aforementioned conventional shapes of jewels, such as round, oval, or square. In a preferred embodiment of the invention, only artificial diamonds such as clear crystals or rhinestones jewels, are used.

Diamonds 48, 49 and 50 are preferably securely and rigidly or permanently mounted in holes 17, 18 and 19 with means such as an adhesive applied around the periphery thereof, by being force fit therein, or with conventional mounting pins, such as are used in mounting a diamond into a setting. Other mounting means can be used and would be apparent to one of ordinary skill in the art. In addition, while holes 17, 18 and 19 have been depicted in the figures as being through holes, handle 10 can have a backing onto which jewels 48, 49, and 50 can be supported or mounted. Such a backing can be transparent so that the jewels can be seen from either side, or it can be opaque. If the backs of the jewels inserted into the holes are flat, then the backing can have an adhesive on it that can either removably or permanently mount the jewels to the backing. The jewels can alternatively be removably mounted in a die-cut hole or opening or can be fixedly mounted in a die-cut hole or opening. The jewels can be wedged in an opening; held in place in an opening by an adhesive of any type; or subjected to a heating process wherein the jewel is force-fit into a bed that allows the jewel to rest against the back of the holder, regardless of die dimension, and then secured therein when the jewels cool; or otherwise secured therein.

Figure 3:
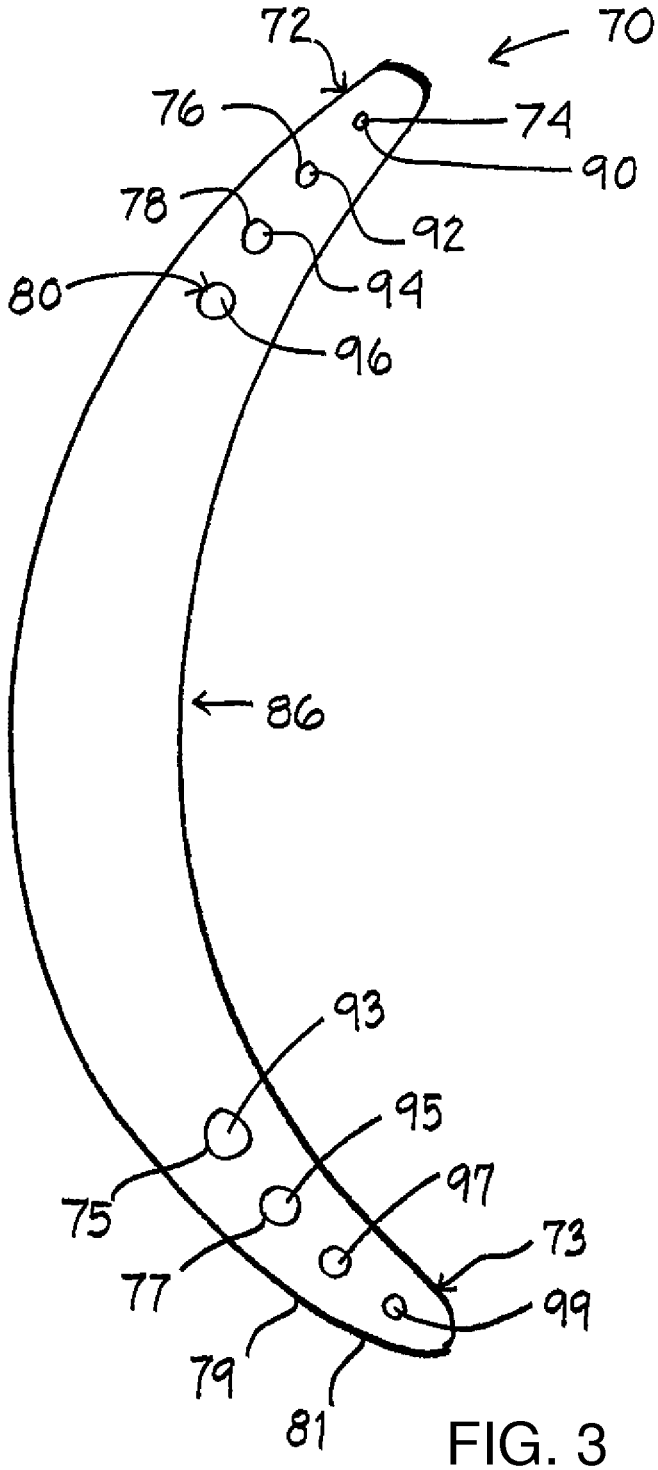
FIG. 3 is a front elevational view of an alternate embodiment of a holder according to the present invention in which the holder has an overall arcuate shape.

In FIG. 3, a jewel holder 70 has a generally arcuate or crescent shape in a front elevational view. The side elevational view is a thin rectangle, somewhat similar to that depicted in FIG. 2, but with different shading lines. Holder 70 has a constant thickness and has a first, pointed end 72 and a second, pointed end 73. End 72 has four bores or holes 74, 76, 78 and 80 therethrough and end 73 with four bores 75, 77, 79 and 81 therethrough. End 73 is also a handle portion 84. Holder 70 has an enlarged or wider mid-portion 86 that is wider than the width of either end 72 or 73 and can also serve as a handle.

Like the holes in the first embodiment depicted in FIGS. 1 and 2, holes 74-81 receive corresponding jewels. In the example of FIG. 3, holes 74, 76, 78, and 80 receive jewels that are clear diamonds (which can be simulated or real) 90, 92, 94 and 96 having sizes or weights, respectively, of 0.25 carats, 0.50 carats, 0.75 carats, and 1.00 carats. Each of the holders described herein can have any number of holes (e.g., one, two, three, four, etc.). These diamonds are fixedly mounted in their corresponding holes with means that can be the same used to mount the jewels in the holes in FIGS. 1 and 2. Hole 75 mounts a jewel 93 that is also a clear diamond (which can be simulated or real) having a size or weight of 2.00 carats. Holes 77, 79 and 81 are the same size and mount jewels 95, 97, and 99 that are the same size or weight, but are colored diamonds, blue, red, and yellow respectively, and can be simulated or real. The colors are exemplary and they can be of any commercially available color. With different colors, the selection of a particular type can easily be made. Obviously, the number of holes, the size of the holes and the arrangement of the holes are exemplary and other sizes and arrangements would be readily apparent.

Figure 4:
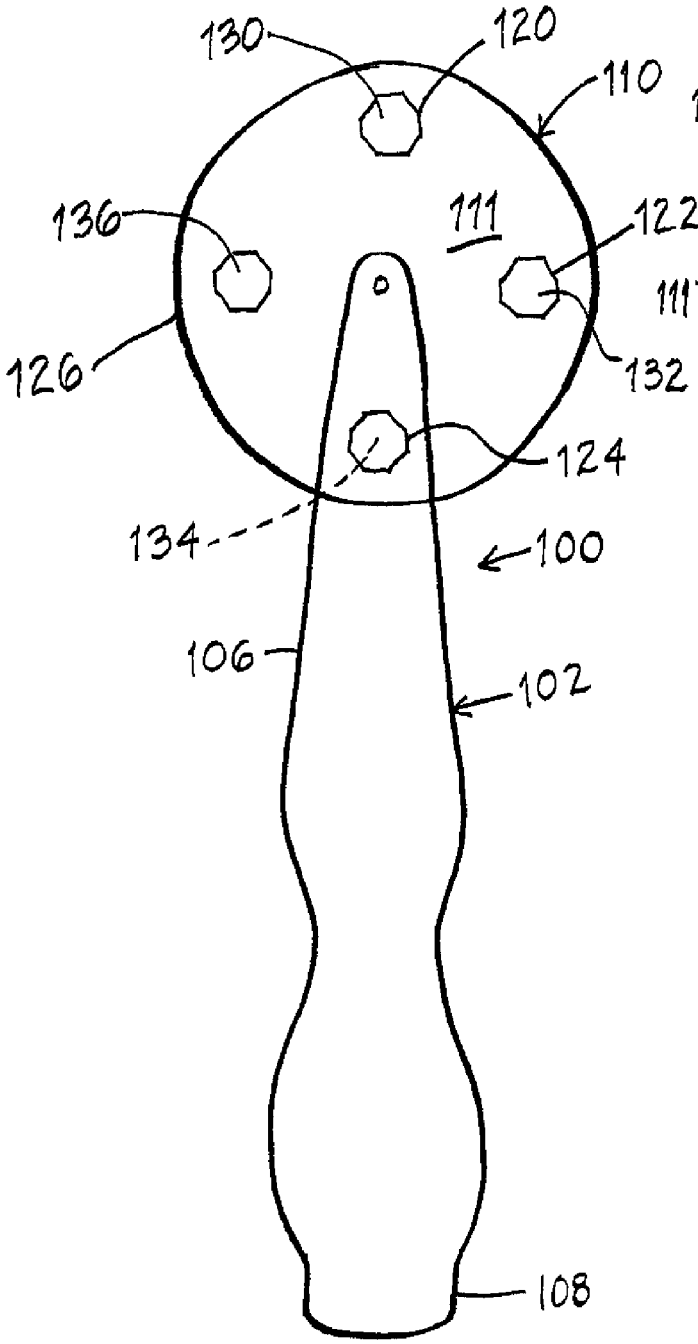
FIG. 4 is a front elevational view of an alternate embodiment of a holder according to the present invention having a wheel attached to the distal tip of the holder.
Figure 5:
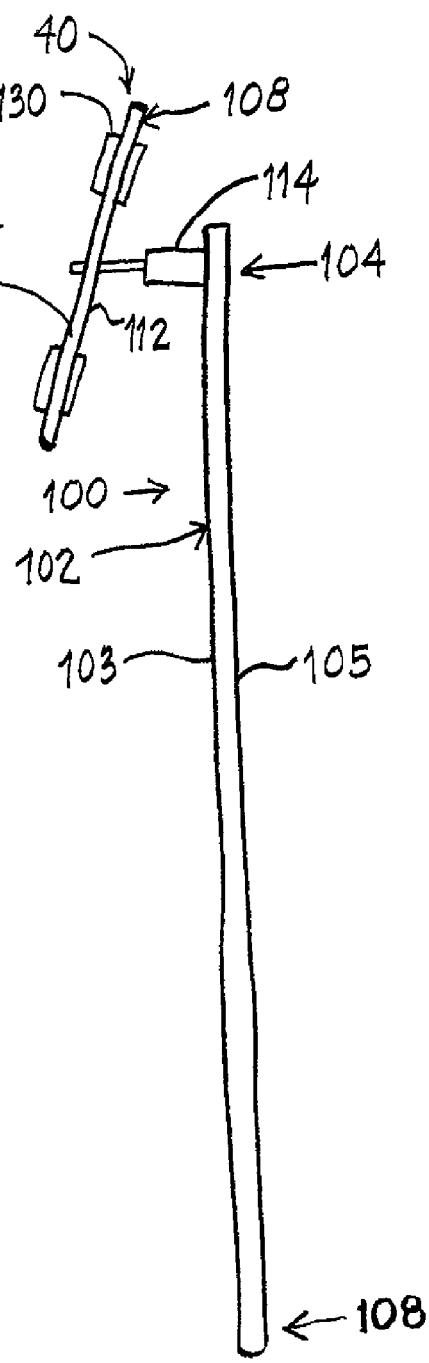
FIG. 5 is a side elevational view of the holder of FIG. 4.

In FIGS. 4 and 5, a generally collinearly shaped jewel wand or holder 100 of a third embodiment in accordance with the present invention is depicted. Holder 100 is comprised of an elongated, one-piece base or body 102 that is symmetrical about a central longitudinal axis and is generally the size and shape of holder 10 in FIGS. 1 and 2, described hereinabove. Holder body 102 has a front side surface 103 and a back side surface 105. Holder 100 also has a rounded first end 104 at the terminus of an elongate triangular or pointed portion 106 and a rounded second end 108. A flat disk 110 having a front side surface 111 and a back side surface 112 is rotatably attached to first end 104 with an axle 114. Disk 108 has four holes, 120, 122, 124 and 126 therethrough, which are spaced equally radially apart. Four jewels 130, 132, 134 and 136, which have irregular and different shapes and sizes, are mounted therein by the same means as described hereinabove with respect to FIGS. 1 and 2. However, unlike the aforedescribed jewels, jewels 130, 132, 134 and 136 have a thickness that is greater than the thickness of disk 108 and thus extend beyond both front side surface 111 and back side surface 112.

Figure 6:
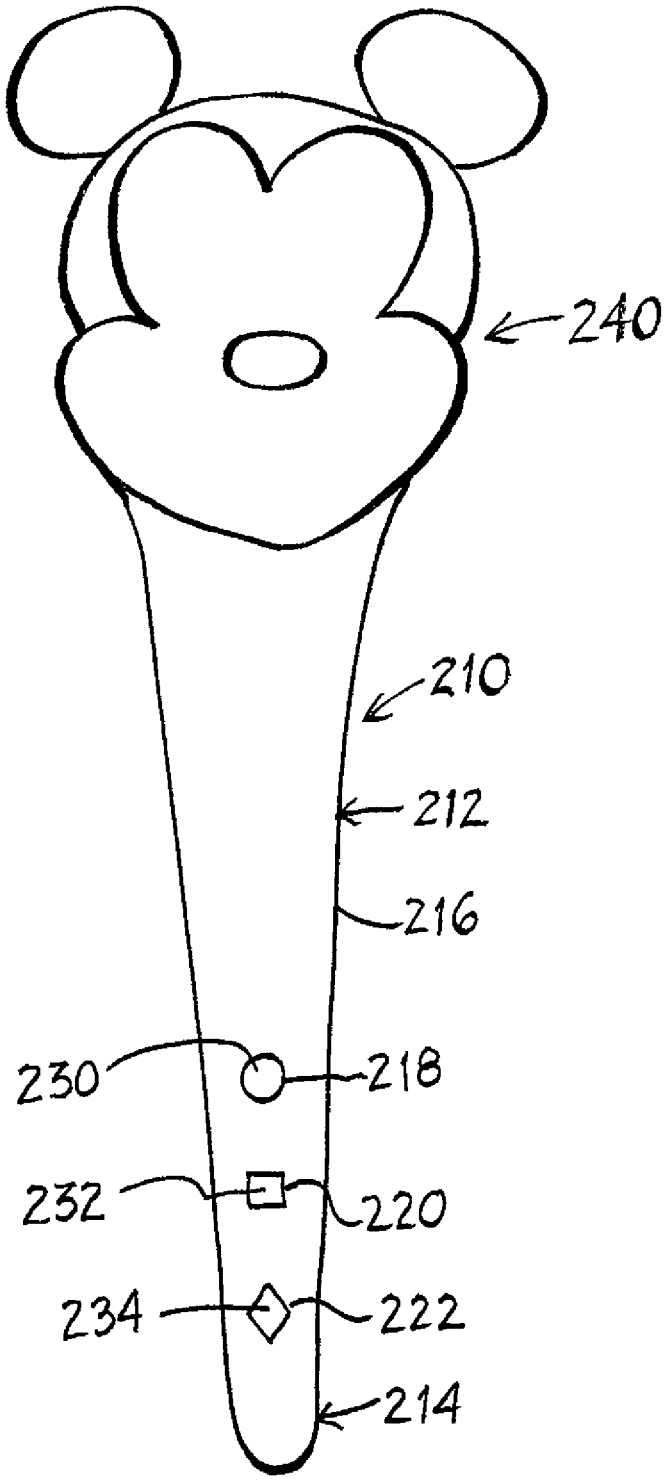
FIGS. 6 through 8 are front elevational views of alternate embodiments of holders according to the present invention having at least one end of the holder in the shape of a design.

In FIG. 6, an alternative embodiment of a generally collinearly shaped earring wand or holder 210 in accordance with the present invention is depicted. Holder 210 is comprised of an elongated, one-piece base or body 212 that is symmetrical about a central longitudinal axis (not shown). Holder 210 has a rounded first end 214 at the terminus of an elongate triangular or pointed portion 216 with three distinctly spaced bores or holes 220, 222 and 224 spaced apart longitudinally from first end 214 and extending completely through body 212. Jewels 230, 232, 234 are mounted respectively in holes 220, 222 and 224 therein by the same means as described hereinabove with respect to FIGS. 1 and 2. Jewels 230, 232 and 234 are of the same type, such as an emerald, and have the same sizes or weights, but have different shapes. Thus, jewel 230 has a round cut, jewel 232 has a square cut and jewel 234 has a pear shape cut. The holder has a second end portraying a design cutout of the cartoon character Mickey Mouse 240 mounted on or molded with holder 210.

Figure 7:
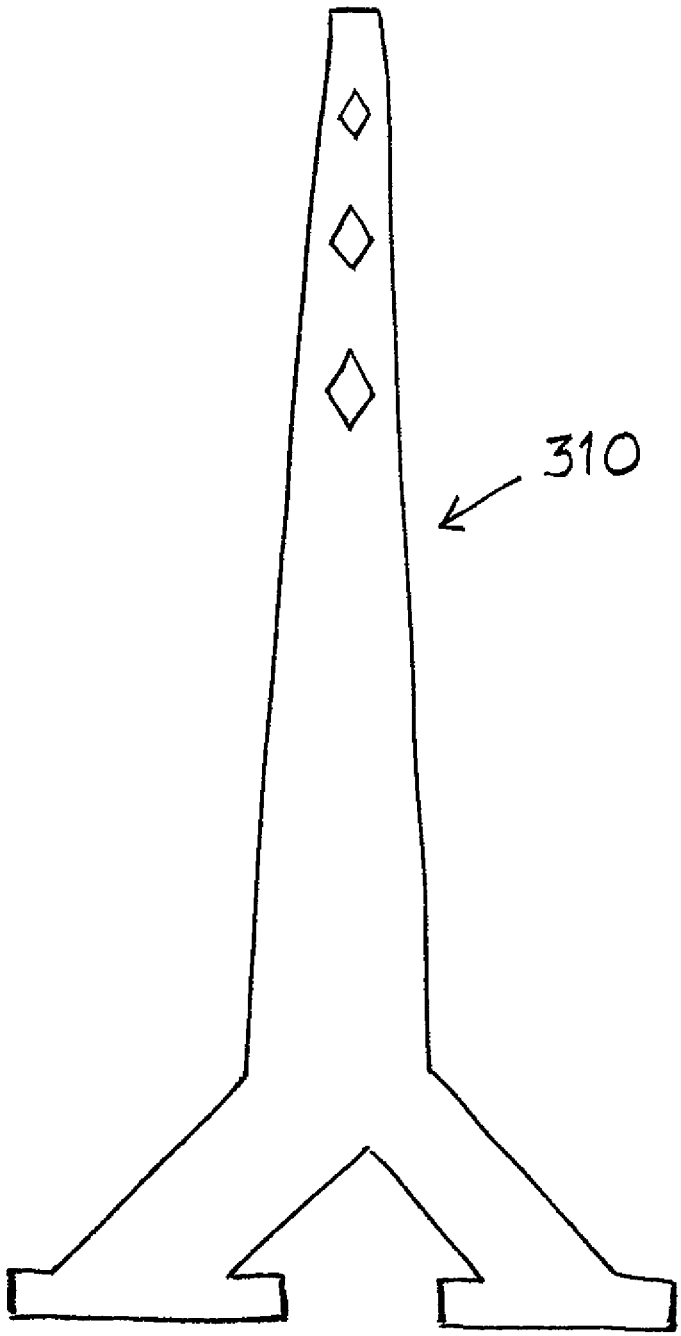
Figure 8:
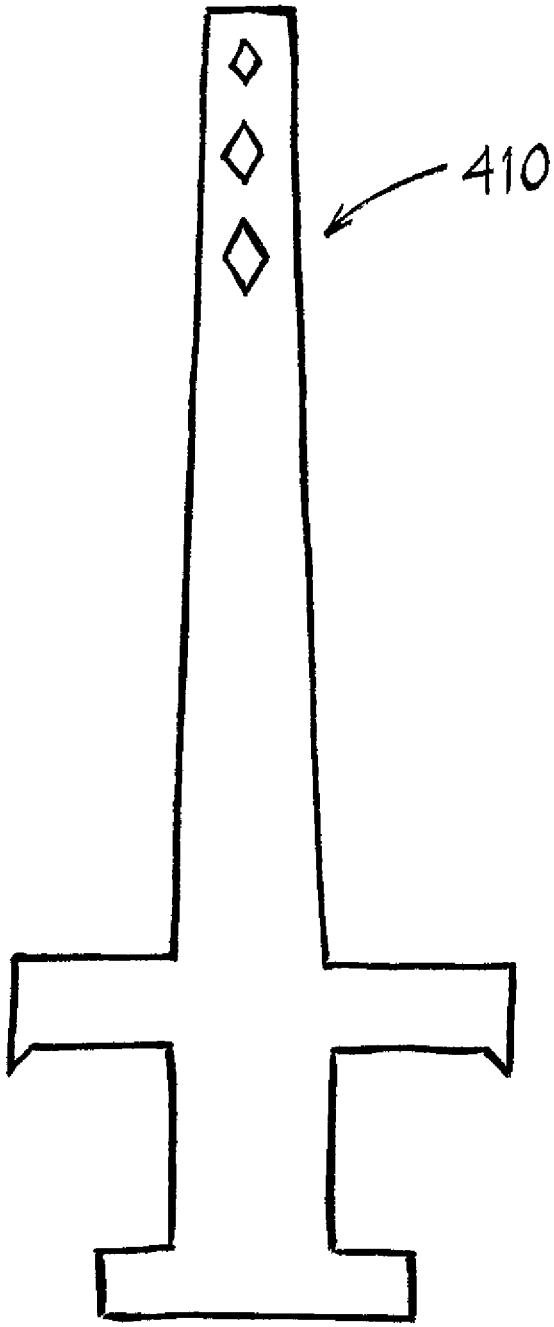

FIGS. 7 and 8 depict other variations in the design and shape of the holder that can incorporate the famous logo of a famous company. Thus, for example, FIG. 7 depicts holder 310 that incorporates the initials of David Yurman, and FIG. 8 depicts a holder 410 that incorporates an initial of Tiffany's. Of course, the holder could incorporate the logo design, emblem or initials of other companies, such as Zales, Macy's and even a "Mom and Pop" store or chain.

In use a jewel holder 10 provides a viewing opportunity to see and determine how a jewel having a particular type, shape, size and color will appear against an object, such as a piece of jewelry, clothing or a part of the body of the user. A jewel holder 10 preferably made of a transparent material and containing a plurality of aligned jewels is selected according to the type, shape, size and color of the jewels attached to or embedded therein. Alternatively, an empty jewel holder 10 is selected and a variety of jewels is selected and attached to or embedded in upper portion 16 of jewel holder 10. A first selected jewel section of jewel holder 10 containing the particular variety of jewels located in different sections of upper portion 16 is then positioned against the object, which for exemplary purposes only, will be assumed to be a part of the body of the user. Then one selected jewel section at a time containing the particular jewel of interest is aligned and displayed at a location on the body where the jewel in an appropriate setting will be worn. The remaining jewel sections are then aligned, one section at a time, at the body location and the appearances of the different jewels are then compared. Additional jewel holders, each having a different combination of jewels, as desired by the user, are selected and the above placing, aligning and displaying steps are repeated for each jewel on each additional jewel holder 10.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure, dimension, and arrangement of parts within the principles of the present invention to the full extent indicated by the broad general meaning of the terms in which the appended claims are expressed. For example, the particular elements may vary depending on the particular application for the web interface such that different dialog boxes are presented to a user that are organized or designed differently while maintaining substantially the same functionality without departing from the scope and spirit of the present invention.

We claim:

1. A jewel holder for the positional display of a plurality of jewels so that a user can determine how any one of the jewels will look when positioned against the body of the user, the jewel holder comprising;

an elongate body that has a thinner width than the length thereof, said body including a first end portion, a mid portion that is integral with said first portion; and a second end portion integral with said mid portion having a size such that said second end portion can be used as a handle by the user of the jewel holder; and a plurality of jewels securely, rigidly, permanently, and fixedly attached at said first end, said jewels being visible from at least one side of the jewel holder.

2. The jewel holder as claimed in claim 1, wherein said body is one piece and is made of a transparent material, and said first end portion is tapered, and said jewels are fixedly attached to said first tapered end, said jewels spaced longitudinally apart at a minimum distance such that when positioned against said user there is a visually distinctive view of any one jewel, wherein the plurality of jewels fixedly attached at said first end, in an alignment with each other, each of said jewels having different weight, color, or shape from one another.

3. The jewel holder as claimed in claim 2, wherein said body has a width at said tapered first end that is about one-fifth the width of said second end, wherein the plurality of jewels fixedly attached at said first end, in an alignment with each other, each of said jewels having different weight, color, or shape from one another.

4. The jewel holder as claimed in claim 1, wherein said body is made of a clear, transparent, rigid, non brittle, non fogging, thin, lightweight, and scratch resistant plastic material, wherein the plurality of jewels fixedly attached at said first end, in an alignment with each other, each of said jewels having different weight, color, or shape from one another.

5. The jewel holder as claimed in claim 1, wherein said body is made of a lightweight and scratch resistant glass material, wherein the plurality of jewels fixedly attached at said first end, in an alignment with each other, each of said jewels having different weight, color, or shape from one another.

6. The jewel holder as claimed in claim 1, and wherein the elongate body further comprises an axle at the end of said first end portion, and the jewel holder further comprises a disk made of a transparent material and rotatably attached with respect to the axle, said disk having the plurality of jewels embedded in said disk, said jewels spaced apart radially at a minimum distance such that when positioned against said user there is a visually distinctive view of any one jewel, wherein the plurality of jewels fixedly attached at said first end, in an alignment with each other, each of said jewels having different weight, color, or shape from one another.

7. The jewel holder as claimed in claim 1, wherein said first end portion, said middle portion, said second end portion of said body are symmetrical about its own axis, wherein the plurality of jewels fixedly attached at said first end, in an alignment with each other, each of said jewels having different weight, color, or shape from one another.

8. The jewel holder as claimed in claim 7, wherein said axes of said first end portion, said middle portion, and said second end portion of said body are collinear in a front elevation view, wherein the plurality of jewels fixedly attached at said first end, in an alignment with each other, each of said jewels having different weight, color, or shape from one another.

9. The jewel holder as claimed in claim 1, wherein said second end portion portrays a design including a design cutout of the cartoon character, wherein the plurality of jewels fixedly attached at said first end, in an alignment with each other, each of said jewels having different weight, color, or shape from one another.

10. The jewel holder as claimed in claim 1, wherein the axes of said first end portion, said middle portion, and said second end portion of said body form an arcuate shape in a front elevation view, with the plurality of jewels fixedly attached to said first tapered end, said jewels spaced arcuately apart at a minimum distance such that when positioned against said user there is a visually distinctive view of any one jewel, wherein the plurality of jewels fixedly attached at said first end, in an alignment with each other, each of said jewels having different weight, color, or shape from one another.

11. The jewel holder as claimed in claim 10, wherein said second end portion is tapered and has a second plurality of jewels fixedly attached to said second tapered end, said second jewels spaced arcuately apart at a minimum distance such that when positioned against said user there is a visually distinctive view of any one jewel, wherein the plurality of jewels fixedly attached at said first end, in an alignment with each other, each of said jewels having different weight, color, or shape from one another.

12. The jewel holder as claimed in claim 1, wherein said plurality of jewels are of different weight, but of the same jewel type, shape and color, and are vertically aligned in said holder in the order of the weight thereof, wherein the plurality of jewels fixedly attached at said first end, in an alignment with each other, each of said jewels having different weight, color, or shape from one another.

13. The jewel holder as claimed in claim 1, wherein said plurality of jewels are of the same jewel type and have the same weight and color but are in a variety of shapes, wherein the plurality of jewels fixedly attached at said first end, in an alignment with each other, each of said jewels having different weight, color, or shape from one another.

14. The jewel holder as claimed in claim 1, wherein said plurality of jewels are in a variety of colors, and have the same type, weight and shape, wherein the plurality of jewels fixedly attached at said first end, in an alignment with each other, each of said jewels having different weight, color, or shape from one another.

15. The jewel holder as claimed in claim 1, wherein said plurality of jewels are of various jewel types of the same weight, wherein the plurality of jewels fixedly attached at said first end, in an alignment with each other, each of said jewels having different weight, color, or shape from one another.

16. The jewel holder as claimed in claim 1, further comprising a second plurality of jewels fixedly attached at said second end, each of the second jewels having different weight, color, or shape from one another, wherein the plurality of jewels fixedly attached at said first end, in an alignment with each other, each of said jewels having different weight, color, or shape from one another.

17. A method for viewing how an individual jewel among a plurality of jewels will appear against an object comprising:

providing a jewel holder having an elongate body that has a thinner width than the length thereof, and made of a transparent material and containing a plurality of aligned jewels securely, rigidly, permanently, and fixedly attached to said holder;

placing the holder against the object; and aligning the particular jewel of interest at a location on the object where the jewel is desired to be displayed, wherein each of the jewels has different weight, color, or shape from one another.

* * * * *